US009120600B1

(12) United States Patent
Bubilek

(10) Patent No.: US 9,120,600 B1
(45) Date of Patent: Sep. 1, 2015

(54) COLLAPSIBLE BASKET

(71) Applicant: Tomas Bubilek, Pasadena, CA (US)

(72) Inventor: Tomas Bubilek, Pasadena, CA (US)

( * ) Notice: Subject to any disclaimer, the term of this patent is extended or adjusted under 35 U.S.C. 154(b) by 0 days.

(21) Appl. No.: 14/212,922

(22) Filed: Mar. 14, 2014

Related U.S. Application Data

(60) Provisional application No. 61/785,718, filed on Mar. 14, 2013.

(51) Int. Cl.
*B65D 21/08* (2006.01)

(52) U.S. Cl.
CPC ..... *B65D 21/086* (2013.01)

(58) Field of Classification Search
CPC ..... B65D 11/18; B65D 11/1846; B65D 7/24; B65D 7/26; B65D 21/086
USPC ..... 220/6, 4.01, 7, 4.28, 4.29; 206/170, 206/198; 224/539, 542, 543, 497, 42.34
See application file for complete search history.

(56) References Cited

U.S. PATENT DOCUMENTS

| | | | | |
|---|---|---|---|---|
| 4,147,286 | A * | 4/1979 | Bates et al. | 294/169 |
| 4,235,331 | A * | 11/1980 | Bates et al. | 206/170 |
| 6,893,030 | B2 * | 5/2005 | Shapiro | 280/47.34 |
| 2007/0175892 | A1 * | 8/2007 | Izumi | 220/9.4 |
| 2009/0145791 | A1 * | 6/2009 | Panosian et al. | 206/379 |

* cited by examiner

*Primary Examiner* — Fenn Mathew
*Assistant Examiner* — Don M Anderson
(74) *Attorney, Agent, or Firm* — Roy L. Anderson; Wagner, Anderson & Bright PC

(57) ABSTRACT

A collapsible basket with two separate basket compartments attached to a center frame. Each basket compartment can be unfolded from a folded state into a fully unfolded state in which it forms a basket space defined by four sides rising substantially perpendicularly from a forward bottom. For each basket compartment, two of its three sides are hingedly connected to the center frame and to an intermediate side that is also hingedly connected to a bottom.

16 Claims, 4 Drawing Sheets

COLLAPSIBLE BASKET

CROSS REFERENCE TO RELATED APPLICATIONS

This application is a non-provisional patent application which claims priority rights to U.S. Ser. No. 61/785,718, filed Mar. 14, 2013, the disclosure of which is specifically incorporated herein by reference in its entirety.

FIELD OF THE INVENTION

The present invention is in the field of collapsible baskets.

BACKGROUND OF THE INVENTION

Paper and plastic bags have long been used at check-out counters for a variety of products. However, in recent times, there has been a movement toward reusable bags, and some jurisdictions are going so far as to ban plastic bags unless they are purchased by a consumer.

One alternative to disposable bags is a canvass bag with two handles and, often, a shoulder strap. Such an option promotes reusability. However, such bags provide little rigidity and can be stained by liquids, leading to undesirable results.

The present invention provides an alternative to disposable bags while also providing a superior product that is compact, strong and easy to use.

SUMMARY OF THE INVENTION

The present invention is generally directed to a collapsible basket in which two separate basket compartments are attached to a center frame and each of the basket compartments can be unfolded from a folded state into a fully unfolded state in which it forms a basket space defined by four forward sides rising substantially perpendicularly from a forward bottom.

The two basket compartments can form a single full basket space when they are both in the fully unfolded state. Such a space is defined by two opposing structures, each of which has a bottom (that can be supported on one side by the center frame) and three side walls rising substantially perpendicularly from the bottom. The three side walls are hingedly connected to each other, the second side wall being hingedly connected to the other two while the first and third side walls are also hingedly connected to the center frame, while the bottom is hingedly connected to middle side wall.

Either of the opposing basket compartments can be changed from an unfolded state to a folded state by folding its bottom toward the second, intermediate side wall, then folding the bottom and the second side wall toward the third forward side wall, then folding the second side wall, the bottom and the third side wall toward the first side wall, and then securing the collapsible basket compartment in the folded state (in which the second side wall is between the first side wall and the bottom and the bottom is between the second and the third side walls).

Accordingly, it is primary object of the present invention to provide an improved collapsible basket.

This and further objects and advantages will be apparent to those skilled in the art in connection with the drawings and the detailed description of the invention set forth below.

BRIEF DESCRIPTION OF THE DRAWINGS

FIG. 1 is a slightly offset view of a collapsible basket according to the present invention in which both of its compartments are in a fully unfolded state while

FIG. 4 illustrates the collapsible basket of FIG. 1 when both of its compartments are folding into a folded state in which the bottom sides have been folded upwards and the three sides have begun to be folded together while FIG. 5 illustrates a top view of the fully collapsed basket which

DETAILED DESCRIPTION OF THE INVENTION

In the Figures and the following description, number designations indicate various features of the invention, with like number designations referring to like features throughout both the drawings and the description. Although the Figures are described in greater detail below, the following is a glossary of the elements identified in the Figures.

GLOSSARY

Figure 1:
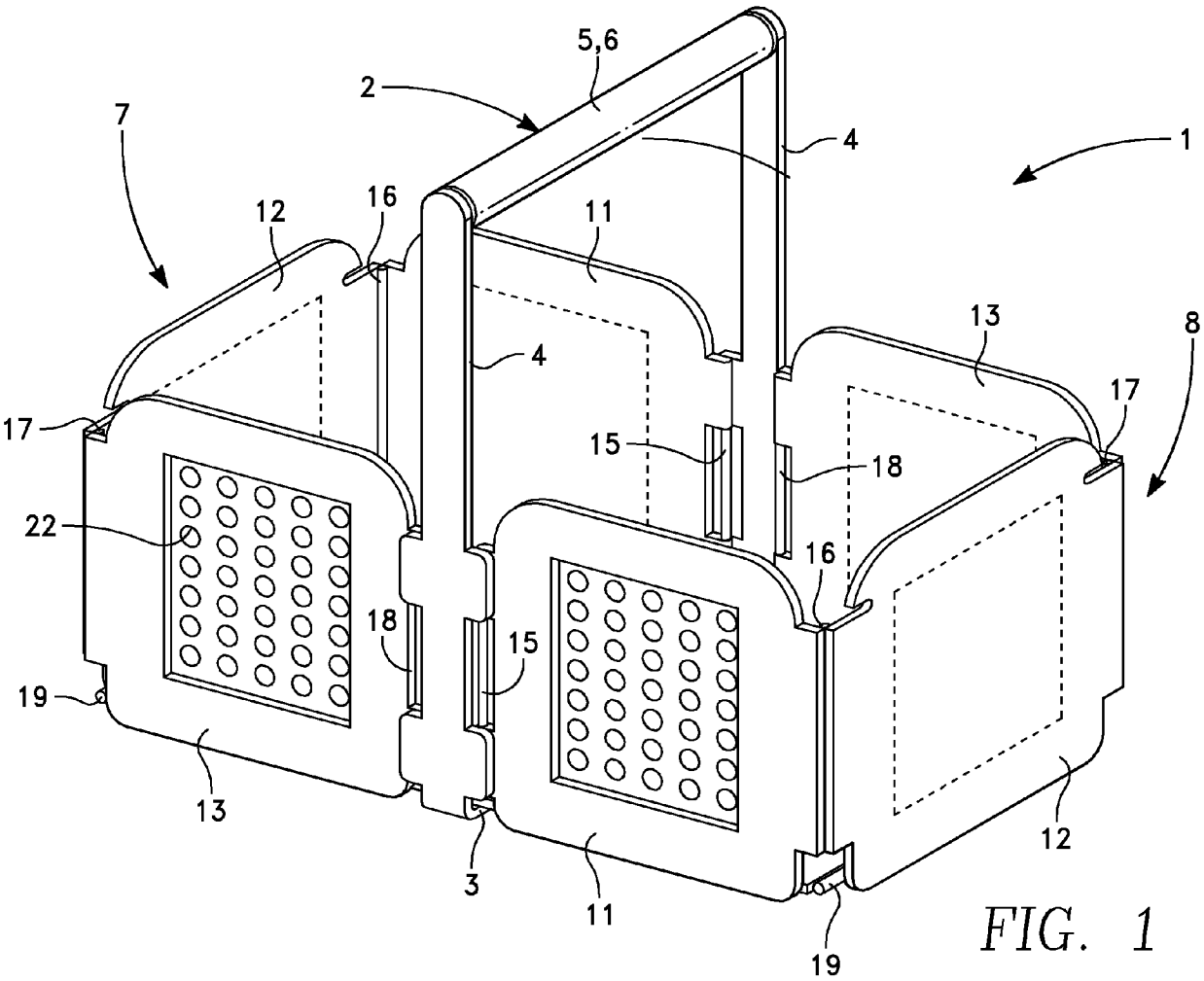
Figure 2:
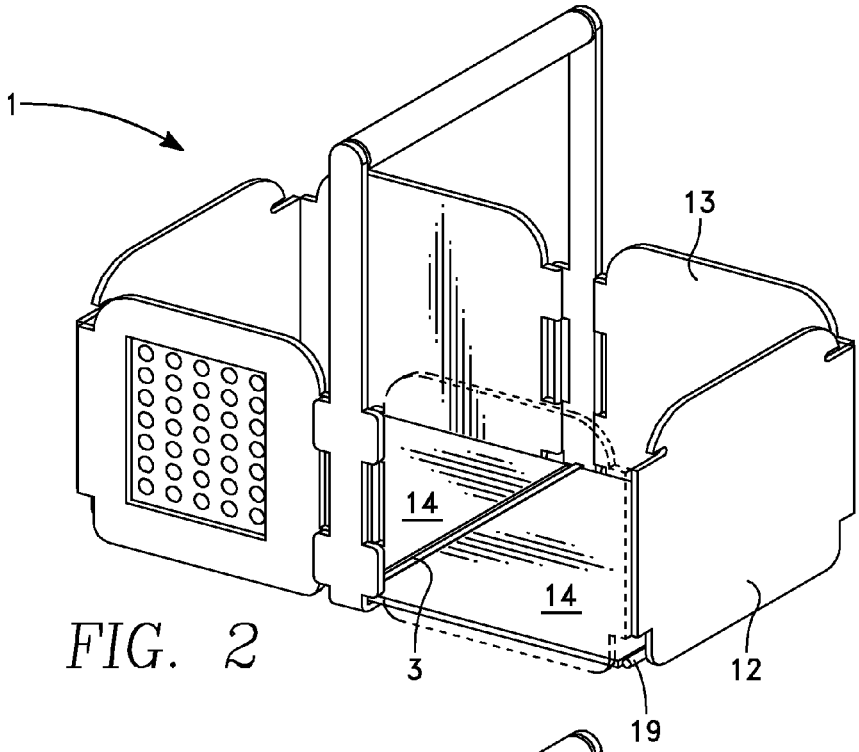
FIG. 2 shows a side wall in phantom lines and then
Figure 3:
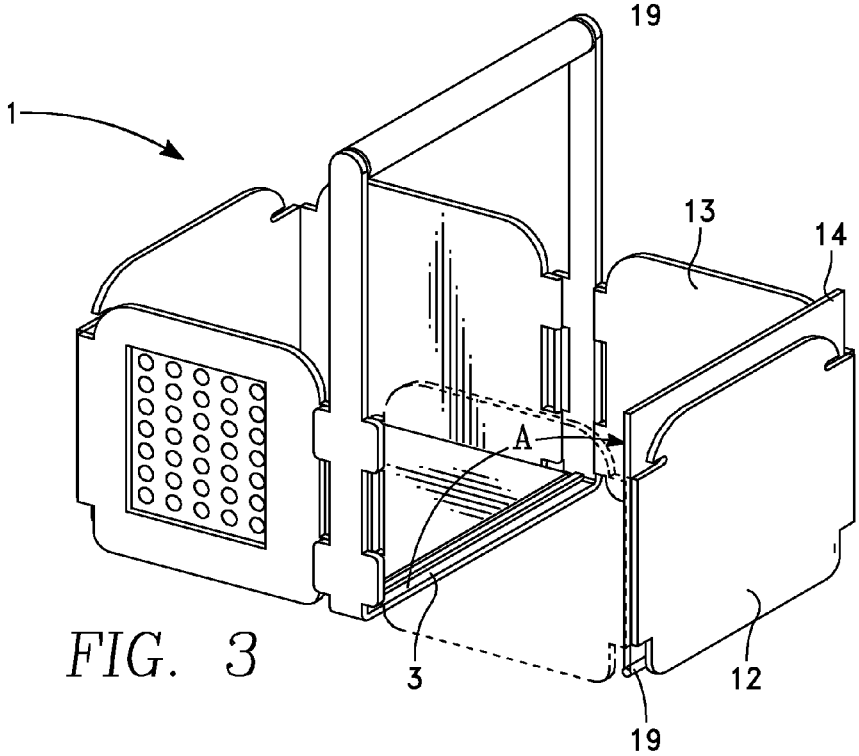
FIG. 3 shows the bottom side of one compartment folded up.
Figure 6:
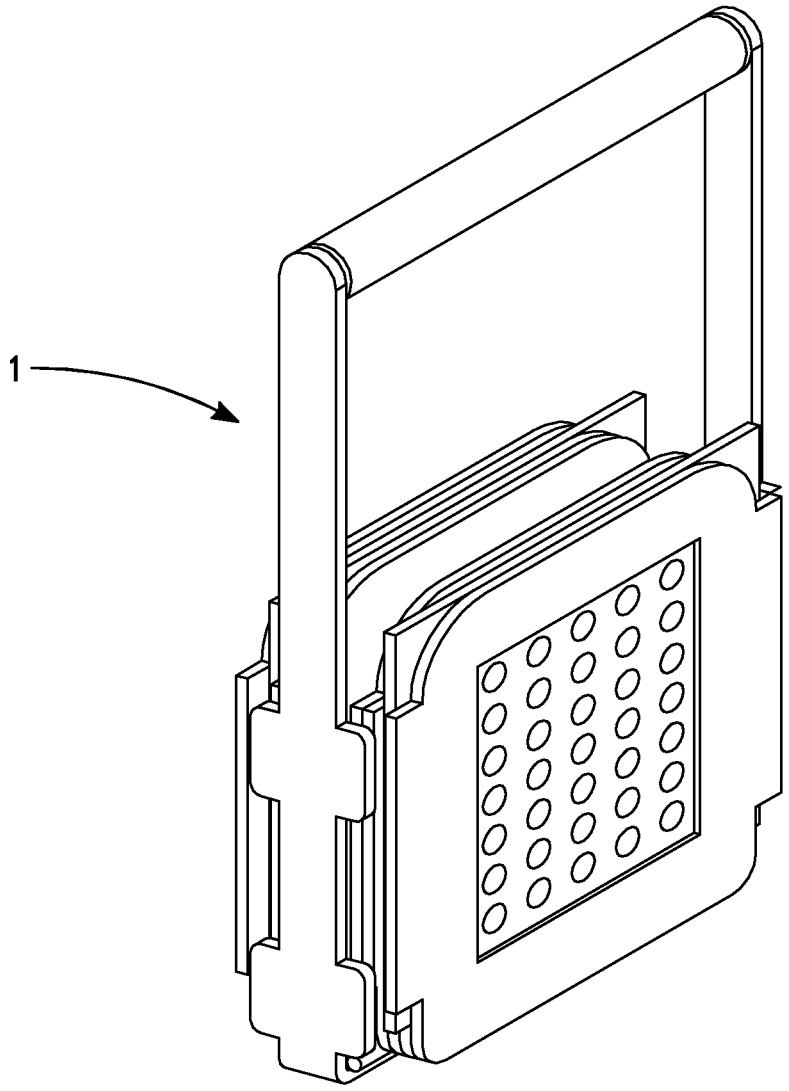
FIG. 6 shows from an offset view.

1 collapsible basket
2 center frame
3 bottom member (of center frame 2)
4 side member (of center frame 2)
5 top member (of center frame 2)
6 handle
7 forward collapsible basket
8 rear collapsible basket
11 first side
12 second side
13 third side
14 bottom side
15 first hinge (connecting first side 11 to side member 4)
16 second hinge (connecting first side 11 to second side 12)
17 third hinge (connecting second side 12 to third side 13)
18 fourth hinge (connecting third side 13 to side member 4)
19 fifth hinge (connecting bottom side 14 to second side 12)
22 hole A collapsible basket of the present invention, shown generally as 1 in FIGS. 1 and 6, can go from a compact state in which its two compartments are in a folded state (see FIG. 6) to a state in which one of its two compartments is in a fully unfolded state to a fully open state in which both of its two compartments are in a fully unfolded state (see FIG. 1). Each of the two collapsible basket compartments can exist, independently of the state of the other, in either a folded state or a fully unfolded state. This gives a user the option of unfolding a smaller basket if not much basket space is needed, or creating a larger basket space (utilizing both of the collapsible basket components in the fully unfolded state) when more space is needed.

Collapsible basket 1 has a center frame 2 which, in an especially preferred embodiment, is formed as a unitary structural piece having a bottom member 3, two side members 4 and a top member 5. A handle 6 can be formed around top member 5, attached to top member 5 or be included as a separate component of top member 5 (not shown in the Figs.).

Two collapsible basket compartments are affixed to center frame 2 opposing each other and, in an especially preferred embodiment, are mirror images of each other. For ease of reference, one of these two collapsible basket compartments will be called a forward collapsible basket compartment, shown generally as 7, and the other will be called a rear collapsible basket compartment, shown generally as 8. (Of course, by rotating collapsible basket 1 by 180 degrees, the nomenclature will be reversed, so there is no structural distinction between the two, which is why their components will be described by use of the same reference numbers.)

Figure 4:
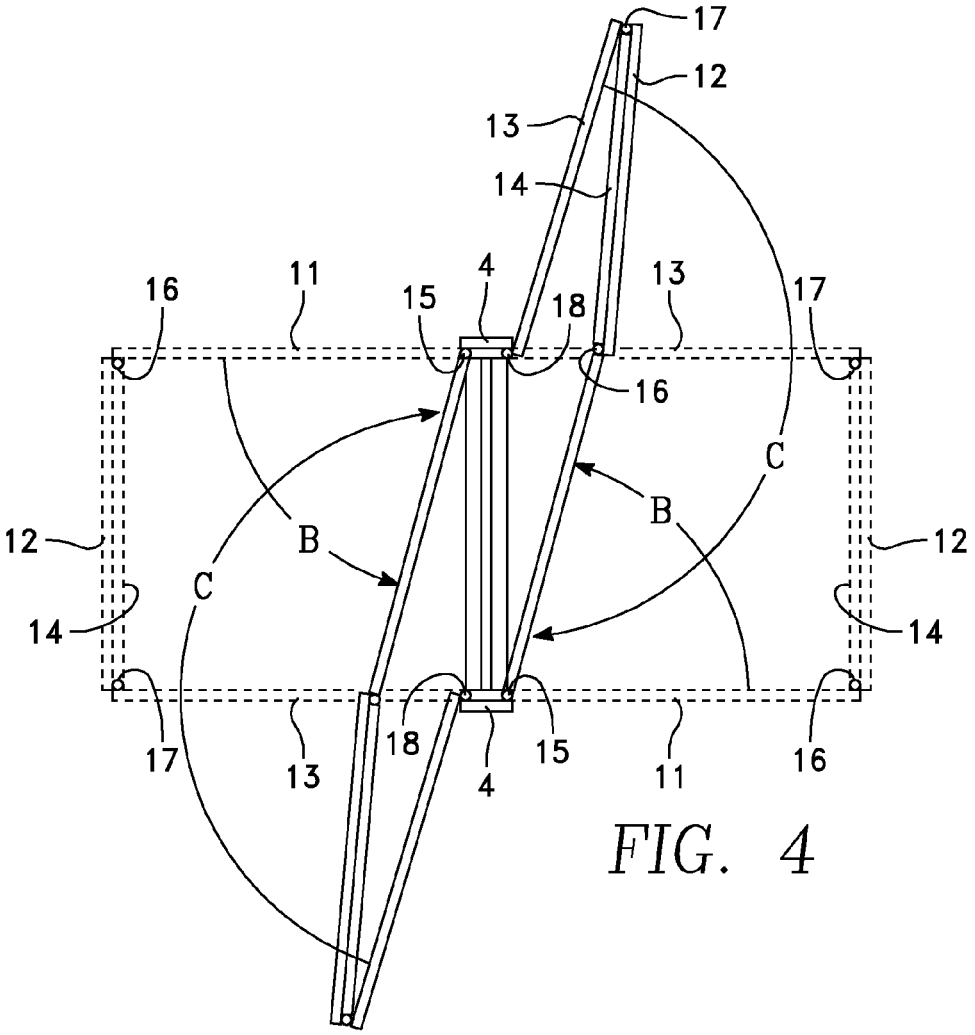
Figure 5:
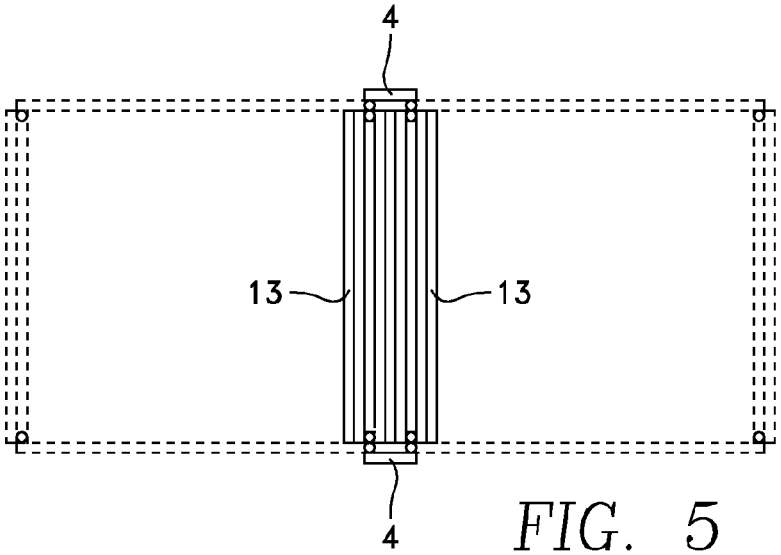

Each of the two collapsible basket compartments has four sides—first side 11 hingedly connected to side member 4 by first hinge 15, third side 13 hingedly connected to the other side member 4 by fourth hinge 18, second side 12 hingedly connected to first side 11 by second hinge 16 and hingedly connected to third side 13 by third hinge 17, and a bottom side 14 hingedly connected to second side 12 by fifth hinge 19. Thus, each of the two collapsible basket compartments has four sides (which are preferably rigid and planar, although they may be fitted with holes 22 for conserving material cost) that are capable of folding up into each other as illustrated in FIGS. 4-5. In one especially preferred embodiment, second and third hinges 16 and 17 may be flexible connections, as opposed to separate structural hinges that must be affixed to each of the sides being hingedly connected, so that a molding process can be used to form first, second and third sides 11-13 and second and third hinges 16 and 17 as an integral component having five elements that will function according to the folding description set forth below, as opposed to five separate components that are later fastened or assembled together, although such integral construction is optional.

The two collapsible basket compartments, in one especially preferred embodiment, have separate fasteners for holding them in the folded state, and either collapsible basket compartment can be maintained in the folded state by using two fastener components to hold the collapsible basket compartment in its folded state. The exact nature and structure of fastener components is not important to the present invention, and any number of such fastener components can be used by one of ordinary skill in the art to accomplish the stated purpose. Thus, for example, the fastener components can be made up of any number of devices such as, by way of limited example only, a snap, hook and eye, a catch, a clasp, a clip, a lock, a slide fastener, a toggle, or the like. Alternatively, either or both collapsible basket compartments can be maintained in the folded state by use of any suitable securing means. For example, a metal hinge could be mounted to side member 4 which, when pushed down, forms a lock with a suitable locking mechanism on one or more of the sides; alternatively, one or more snap fit connections or magnets can be used so that the fully collapsed baskets, as shown in FIG. 6, will stay in the closed position without the need for separate fasteners until a user applies a force to open one or both of the collapsed compartments.

The process for changing either of the two collapsible basket compartments from an unfolded state to a folded state proceeds as follows. First, bottom side 14 is folded toward second side 12 to which it is hingedly connected. (As a result of this step, the two sides may or may not be lying flat against each other, but they will be folded together so that they are substantially parallel to each other and thus function as one of three remaining sides that still need to be folded together.) Second, bottom side 14 and second side 12 are then folded together as one combined side toward third side 13. (As a result of this step, the three sides may or may not be lying flat against each other, but they will folded together so that they are substantially parallel to each other and bottom side 14 is located between second and third sides 12 and 13.) Third, second side 12, bottom side 14 and third side 13 are then folded together as one combined side toward first side 11. (As a result of this step, the four sides may or may not be lying flat against each other, but they will folded together so that they are substantially parallel to each other and second side 12 is located between first side 11 and bottom side 14 while bottom side 14 is located between second and third sides 12 and 13.) Fourth, the collapsible basket compartment, which now has four sides that have been folded together, is secured in the folded state by a fastener. To go from the folded state to the unfolded state, the steps are reversed in reverse order.

In accordance with one especially preferred embodiment of the present invention, each of first, second and third sides 11-13 is of substantially the same shape, while bottom side 14 has a length that is longer so that it rests upon, and is supported by, bottom member 3 in the unfolded state. It is also especially preferred that center frame 2, first through third sides 11-13 and bottom side 14 be made of acrylonitrile butadiene styrene (ABS plastic).

So far the present invention has been described in terms of an embodiment that is ideally suited for folding up into a compact form that is easy to carry, easy to unfold, and easy to use. Because of its structure, especially if it is manufactured from ABS plastic, it will create a solid and rigid basket space that provides much more support than a canvas bag. If desired, center frame 2 can be provided with an additional divider (not shown) so that there will be two separate basket spaces when both of its collapsible basket compartments are in an unfolded state, instead of a single combined space. When only one of the collapsible basket compartments is in the unfolded state, and the other is in the folded state, the collapsible basket compartment in the folded state functions as a fourth side of a defined basket space for holding items.

In another preferred embodiment, a collapsible wheel mechanism is attached to each side member 4 of center frame 2. Each collapsible wheel mechanism has a wheel affixed to an extensible support by a fastener. An extensible support can be changed from a collapsed state in which its wheel is not available for use to an extended state in which its wheel is ready for use. The addition of a collapsible wheel mechanism to a collapsible basket according to this embodiment allows a user the option of using something more akin to a wheeled shopping basket, such as in use in some retail outlets today, except that it can be taken by the user to his or her car or home, instead of leaving it at a retail facility.

Although the foregoing detailed description is illustrative of preferred embodiments of the present invention, it is to be understood that additional embodiments thereof will be obvious to those skilled in the art. For example, each of the side and bottom walls might be replaceable with walls of different colors, or any of such walls can have an inner panel (illustrated in FIG. 1 as having thirty-five holes 22) which is detachably connected to a frame structure so as to allow for different colors and panel designs to accommodate aesthetic desires of a user while also allowing individual customers to customize their own collapsible basket, or customize multiple collapsible baskets designed for different uses. Further modifications are also possible in alternative embodiments without departing from the inventive concept.

Accordingly, it will be readily apparent to those skilled in the art that still further changes and modifications in the actual concepts described herein can readily be made without departing from the spirit and scope of the disclosed inventions as defined by the following claims.

What is claimed:

1. An apparatus, comprising:

a center frame;

a pair of three-piece sides, each of which comprises:

a first side connected to the center frame by a first hinge;

a third side connected to the center frame by a fourth hinge;

a second side connected to the first side opposite the first hinge by a second hinge and also connected to the third side opposite the fourth hinge by a third hinge; and a bottom side connected to the second side of one of the three-piece sides by a fifth hinge; and at least one fastener for retaining the pair of three-piece sides in a folded state;

wherein in the folded state the bottom side of each of the pair of three-piece sides is folded up toward the second side to which it is connected while the first, the second and the third sides of said each of the pair of three-pieces sides are folded together and held in place by the at least one fastener such that the first side of each of the pair of three-piece sides are adjacent each other and, for each of the pair of three-piece sides, the second side is located between the first side and the bottom side while the bottom side is located between the second side and the third side; and wherein in a fully unfolded state the bottom side of each of the pair of three-piece sides is folded down toward and supported by the center frame.

2. The apparatus of claim 1, wherein the at least one fastener will retain one of the pair of three-piece sides in the folded state while the other of the pair of three-piece sides is in the fully unfolded state.

3. The apparatus of claim 1, further comprising a handle attached to the center frame for carrying the apparatus.

4. The apparatus of claim 1, wherein the second and the third hinges are comprised of a flexible connection.

5. The apparatus of claim 1, wherein the at least one fastener is comprised of a pair of fasteners and each of said pair of fasteners retains one of the pair of three-piece sides in the folded state.

6. The apparatus of claim 5, wherein each of the pair of fasteners is comprised of a clasp.

7. The apparatus of claim 5, wherein each of the pair of fasteners is comprised of a first component affixed to the center frame and a second component affixed to the third side of one of the pair of three-piece sides.

8. The apparatus of claim 1, further comprising a collapsible wheel mechanism connected to the center frame.

9. A collapsible basket, comprising:

a center frame;

a forward collapsible basket compartment attached to the center frame; and a rear collapsible basket compartment attached to the center frame;

wherein the forward collapsible basket can compartment be unfolded from a folded state into a fully unfolded state in which it forms a forward basket space defined by four forward sides rising substantially perpendicularly from a forward bottom when the rear collapsible basket compartment is in the folded state while the rear collapsible basket compartment can be unfolded from the folded state into the fully unfolded state in which it forms a rear basket space defined by four rear sides rising substantially perpendicularly from a rear bottom when the forward collapsible basket compartment is in the folded state;

wherein the forward collapsible basket compartment is further comprised of a first and a third forward side wall, each of which is connected to the center frame, and a second forward side wall connected on one vertical side to the first forward side wall and on another vertical side to the third forward side wall; and wherein the rear collapsible basket compartment is further comprised of a first and a third rear side wall, each of which is connected to the center frame, and a second rear side wall connected on one vertical side to the first rear side wall and on another vertical side to the third rear side wall; and wherein the four forward sides are comprised of the first forward side wall, the second forward side wall, the third forward side wall and either the first or the third rear side wall, and wherein the four rear sides are comprised of the first rear side wall, the second rear side wall, the third rear side wall and either the first or the third forward side wall.

10. The collapsible basket of claim 9, wherein the forward basket space and the rear basket space form a single full basket space when both the forward collapsible basket and the rear collapsible basket are in the fully unfolded state.

11. The collapsible basket of claim 10, wherein the single full basket space is defined by the forward bottom, the rear bottom, three forward side walls rising substantially perpendicularly from the forward bottom and three rear side walls rising substantially perpendicularly from the rear bottom.

12. The collapsible basket of claim 9, wherein the first forward side wall is hingedly connected to the center frame and the second forward side wall; the second forward side wall is hingedly connected to the first forward side wall, the third forward side wall and the forward bottom; the third forward side wall is hingedly connected to the second forward side wall and the center frame; the first rear side wall is hingedly connected to the center frame and the second rear side wall; the second rear side wall is hingedly connected to the first rear side wall, the third rear side wall and the rear bottom; and the third rear side wall is hingedly connected to the second rear side wall and the center frame.

13. The collapsible basket of claim 12, wherein in the folded state the forward bottom is folded up toward the second forward side wall to which it is connected while the first, the second and the third forward side walls of said forward and rear collapsible basket compartments are folded together and held in place by the at least one fastener mechanism such that the first side of each of the forward and rear collapsible basket compartments are adjacent each other and, for each of the forward and rear collapsible basket compartments, the second side is located between the first side and the bottom side while the bottom side is located between the bottom side and the third side.

14. The collapsible basket of claim 13, wherein the forward bottom and the rear bottom are supported by the center frame when both the forward collapsible basket compartment and the rear collapsible basket compartment are in the fully unfolded state.

15. The collapsible basket of claim 9, further comprising a collapsible wheel mechanism connected to the center frame.

16. A method of using a collapsible basket having a forward collapsible basket compartment and a rear collapsible basket compartment attached to a center frame of the collapsible basket, comprising:

while the forward collapsible basket compartment and the rear collapsible basket compartment are both in a fully unfolded state, folding the forward collapsible basket compartment into a folded state to form a rear basket space defined by four rear sides rising substantially perpendicularly from a rear bottom, the four rear sides comprising a first rear side wall hingedly connected to the center frame, a third rear side wall hingedly connected to the center frame, a second rear side wall hingedly connected to first rear side wall and the third rear side wall, and the forward collapsible basket compartment in the folded state;

wherein the forward collapsible basket compartment is folded into the folded state by the following steps:

folding a forward bottom toward a second forward side wall;

folding the forward bottom and the second forward side wall toward a third forward side wall hingedly connected to the center frame;

folding the second forward side wall, the forward bottom and the third forward side wall toward a first forward side wall that is hingedly connected to the second forward side wall; and securing the forward collapsible basket compartment in the folded state;

wherein, in the folded state, the second forward side wall is between the first forward side wall and the forward bottom and the forward bottom is between the second and the third forward side walls.

* * * * *